US005232222A

United States Patent [19]

Deutch

[11] Patent Number: 5,232,222

[45] Date of Patent: Aug. 3, 1993

[54] RANDOM NUMBER SELECTOR DEVICE AND METHOD

[76] Inventor: Arthur Deutch, 6510 Kendale Lakes Dr. #604, Miami, Fla. 33183

[21] Appl. No.: 964,890

[22] Filed: Oct. 22, 1992

[51] Int. Cl.[5] ..... A63F 5/04

[52] U.S. Cl. ..... 273/142 HA; 273/142 H; 273/141 R

[58] Field of Search ..... 273/142 HA, 142 H, 142 R, 273/142 A, 142 C, 141 R, 161

[56] References Cited

U.S. PATENT DOCUMENTS

| | | | |
|---|---|---|---|
| 1,550,101 | 8/1925 | Schenck | 273/161 |
| 1,617,831 | 2/1927 | Wolke | 273/142 HA |
| 2,095,367 | 10/1937 | Mattson | 273/142 HA |
| 2,370,229 | 2/1945 | Buckley | 273/142 HA |
| 3,716,237 | 2/1973 | Locher | 273/142 H |
| 3,746,344 | 7/1973 | Hodan | 273/141 R |
| 4,674,748 | 6/1987 | Wismer | 273/141 R |
| 4,721,309 | 1/1988 | Miesel | 273/148 R |
| 4,886,271 | 12/1989 | Brown | 273/142 HA |
| 4,984,796 | 1/1991 | Peacock | 273/142 E |
| 5,118,110 | 6/1992 | Jones | 273/142 HA |

FOREIGN PATENT DOCUMENTS

| | | | |
|---|---|---|---|
| 3632203 | 3/1988 | Fed. Rep. of Germany | 273/142 R |
| 2487210 | 1/1982 | France | 273/141 R |

*Primary Examiner*—Benjamin H. Layno
*Attorney, Agent, or Firm*—Levy, Zito & Grandinetti

[57] ABSTRACT

A random number selector device includes a plurality of disks rotatably mounted about a common axis. A first disk includes an outer ring divided into segments where each ring segment contains one or more number arranged sequentially around the disk. A second ring of ring segments is disposed concentrically within the first ring. The ring segments of the second ring include letters arranged alphabetically around the disk. A second disk superimposed on the first disk includes a pointer and a plurality of ring segments, each ring segment includes one or more random numbers. A third disk is superimposed over the second disk and includes a window to view one of the random numbers on the second disk.

20 Claims, 5 Drawing Sheets

RANDOM NUMBER SELECTOR DEVICE AND METHOD

BACKGROUND OF THE INVENTION

1. Field of the Invention

The present invention is directed to a device for randomly selecting a number. More particularly, the invention is directed to a device for selecting lottery numbers based on the input of predetermined information.

2. Description of Related Art

Lottery games have gained widespread acceptance and popularity in many states. Many of the states that operate lottery games, such as the "Lotto game", require the "player" to select a predetermined set of numbers from a larger group of numbers. Typically, the numbers range from 1 to 49. The player selects 5 to 7 numbers that the player hopes will match the numbers of the winning selection. Large sums of money can be won by the player if the player's selected numbers correspond to the winning numbers.

A variety of methods have been used in the past for selecting numbers for the purchase of a lottery ticket. Such methods have included selecting birth dates, using fortune tellers, and using favorite or "lucky" numbers that are routinely selected by the player. The selection of a large number of random numbers, when a plurality of tickets are purchased simultaneously, can be difficult, time consuming, and agonizing for the player.

Numerous devices have been produced to aid the lottery player in selecting random numbers. In many jurisdictions, the player is able to use a computer to randomly select the numbers when the lottery ticket is purchased and printed. Many players, however, lack confidence in the "state operated" computer to select their numbers and, thus, these players desire alternative methods for producing random lottery numbers. Many number selection devices are designed to function by a free-spinning disk or ball which stops in a space having a designated number. One such device includes a wallet-like case. A disk is rotated by hand and a color is selected through an aperture in the disk to randomly select a number. The player performs a series of hand manipulations and color choices to select the series of numbers.

Other devices for randomly selecting numbers include the device described in U.S. Pat. No. 4,886,271 to Brown. The device includes an upper and lower disk, center planar support having two holes, and a handle. The upper and lower disks have inertia weights for gyration attached thereto. The upper disk includes a number of protruding pegs to serve as a number eliminator. The center support includes two viewing ports that align with numbers on the lower disk. In operation, the disks are rotated with respect to the handle and the numbers selected by viewing the lower disk through the openings in the center support.

U.S. Pat. No. 4,674,748 to Wismer discloses a random number selection device including a base disk, an outer disk, a middle disk having three rings thereon, and an inner disk. All of the disks are rotatable about a common axis. The base disk, outer disk, and inner disks each include one ring with a plurality of ring segments having numbers thereon. A plurality of pointers are positioned on the inner disk adjacent to the numbers on the base disk. The device is used by selecting a base set of numbers at random, positioning the pointers adjacent to those numbers on the inner disk, and recording the numbers on the middle disk. The numbers are then recorded in a matrix and the ultimate selection of numbers is made by selecting rows of numbers within the matrix.

Numerous other devices have been produced for selecting random numbers. Examples of such devices are disclosed in U.S. Pat. No. 3,716,237 to Locher, U.S. Pat. No. 4,984,796 to Peacock, U.S. Pat. No. 4,721,309 to Miesel, U.S. Pat. No. 2,095,367 to Mattson, and U.S. Pat. No. 2,370,229 to Buckley.

The above-noted devices have not entirely filled the needs of lottery players who desire to select a plurality of random numbers. Many of these known devices are complex, expensive to manufacture, and do not reliably produce a random number.

There is, therefore, a continuing need for an inexpensive random selection device that is easy to use and is able to select a plurality of numbers in series without repetition.

SUMMARY OF THE INVENTION

The disadvantages and limitations of the previous random number selection devices are obviated by the current invention. The invention provides an effective and simple device for selecting random numbers. It is, therefore, a primary object of this invention to form a device that is able to randomly select a number or series of numbers and a method for randomly selecting a number or series of numbers.

The invention is a random number selection device. The random number selection device comprises a first circular disk having a first circumferential outer ring of first equal-sized ring segments. Each first ring segment has a first indicia thereon, and a second ring concentric with the first outer ring and spaced inwardly therefrom. The second ring has second equal-sized ring segments having second indicia thereon. A second circular disk has a third ring of third equal-sized ring segments. Each of these segments has at least one random number. The second disk has a diameter less than the diameter of the first disk. A third circular disk has a structure adapted to display the third indicia. The first, second, and third circular disks are rotatably coupled about a common central axis.

The invention includes a method for selecting a random number that uses the device described above.

DETAILED DESCRIPTION OF THE INVENTION

The random number selection device according to the invention is simple to manufacture and operate. The device is inexpensive to produce, lightweight, and readily portable. These and other objects of the invention are attained by a random number selection device comprising three disks of different sizes and that are rotatably mounted together about a common central axis. A first disk defines a base disk and includes an outer ring divided into ring segments. Each ring segment includes a series of numbers, such as dates, arranged sequentially around the base disk. Each ring segment can contain a plurality of numbers arranged in radial columns such that the numbers define a plurality of rows of numbers that extend around the disk. In one embodiment, a pair of "joker spaces" are provided in the outer disk.

A second ring is disposed concentrically with the base or first ring and is, also, divided into ring segments. Letters are, desirably, disposed alphabetically in each of the ring segments. In a preferred embodiment of the invention, the second ring is defined by two semicircles of ring segments. One semicircle includes letters arranged alphabetically in a clockwise direction. The other semicircle includes letters arranged alphabetically in a counterclockwise direction.

A second disk is superimposed on the first disk. The second disk includes a pointer which is to be aligned with one of the first ring segments of the first disk, a transparent ring over the second ring of segments of the first disk, and a third ring of ring segments containing random numbers. A third disk has a pointer and a window to view a selective random number from a ring segment of the second disk.

A number is selected by rotating the second disk to align the pointer to a selected number in the outer ring. The third ring is then rotated to align the pointer with the desired letter in the second ring of the first disk and record the displayed number in the window of the third disk is recorded as the selected number.

Figure 1:
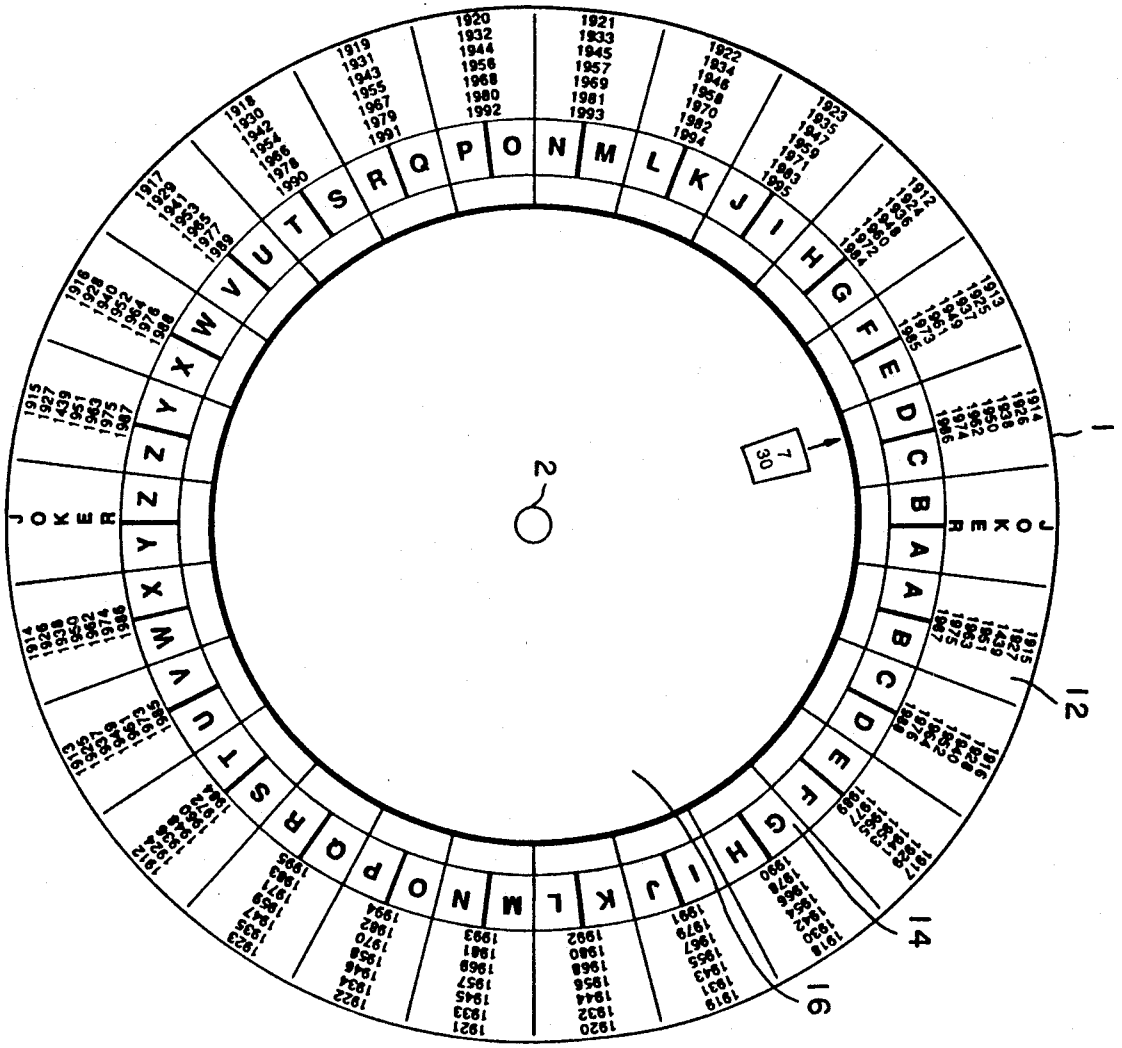
FIG. 1 is a top plan view of the preferred invention.

FIG. 1 illustrates the present invention of a simple and efficient random number selection device. The invention is specifically directed to a random number selection device 1 comprising a base disk 12, a middle disk 14, and an upper, top disk 16. The three disks are rotatably attached together about a common central axis by a spindle 2.

The first disk 12, which provides the base disk 12, includes a first outer ring 18 divided into a plurality of uniform ring segments 20. The outer ring 18 is, generally, positioned contiguous with the outer edge of the disk 12. In further embodiments, the outer ring 18 is spaced inwardly and concentrically with the outer edge of the disk 12 to allow the operator or "user" to grasp the device without obscuring the ring 18.

Figure 2:
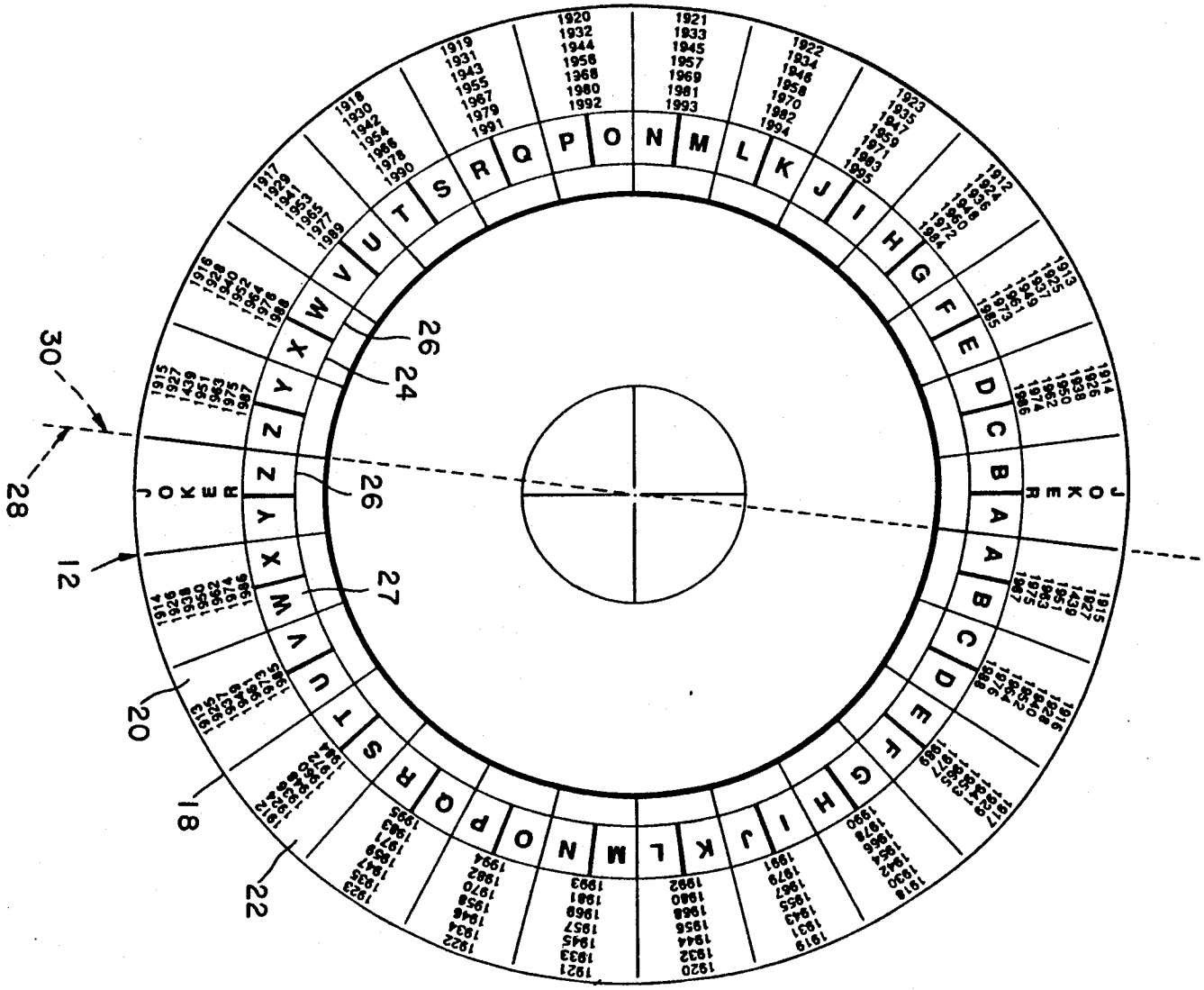
FIG. 2 is a top plan view of the first base disk of the invention in a disassembled condition of the preferred embodiment.

The outer ring 18 includes a large number (represented herein by the variable "n") of segments 20 spaced around the disk 12, as shown in FIGS. 1 and 2. In the preferred embodiment of the invention illustrated in FIG. 2, there are twenty-six ring segments 20 extending around the first disk 12. The ring 18 is divided into two symmetrical halves 28 and 30, each having thirteen ring segments. As shown, the ring segments each contain indicia. The indicia in this embodiment of the invention is in the form of dates. The dates are arranged, in this embodiment, chronologically by year or from the year 1913 to the year 1995. The sequence in the embodiment of the invention in FIG. 2 begins with segment 22 and continues clockwise around each half of the ring to form a column of seven years in each of twelve of the ring segments defining the half of the ring. One of the ring segments in this embodiment does not include the dates, but includes a ring segment designated as a "Joker." Each half of the outer ring 18 is, preferably, symmetrical to the other half of the outer ring 18, such that the years displayed in one segment of one ring half are arranged 180° from the same years displayed in the corresponding ring segment of the other half of the outer ring 18.

The base disk 12, also, includes a second ring 24 continuous with the first ring 18. The second ring 24 is, preferably, concentric to the first ring 18 and is disposed radially inward as shown in FIG. 2. The second ring 24 is divided into ring segments to complement the number of ring segments of the first outer ring 18. In the embodiment of FIG. 2, there are "2n" in number of segments is "2n" such that there are two segments 26 for each segment 20 of the first outer ring 18. Each ring segment 26 includes a single indicia 27. The indicia in the preferred form of the invention is a letter.

The second ring 24 also defines two halves in a similar manner as ring 18. The letters on each ring segment 26 of this embodiment of the invention form a complete set of the alphabet. The first ring half 28 of the second ring 24 has the letters of the alphabet arranged alphabetically in a clockwise direction. The second ring half 30 of the second ring 24 has the letters of the alphabet arranged in a counterclockwise direction.

Figure 3:
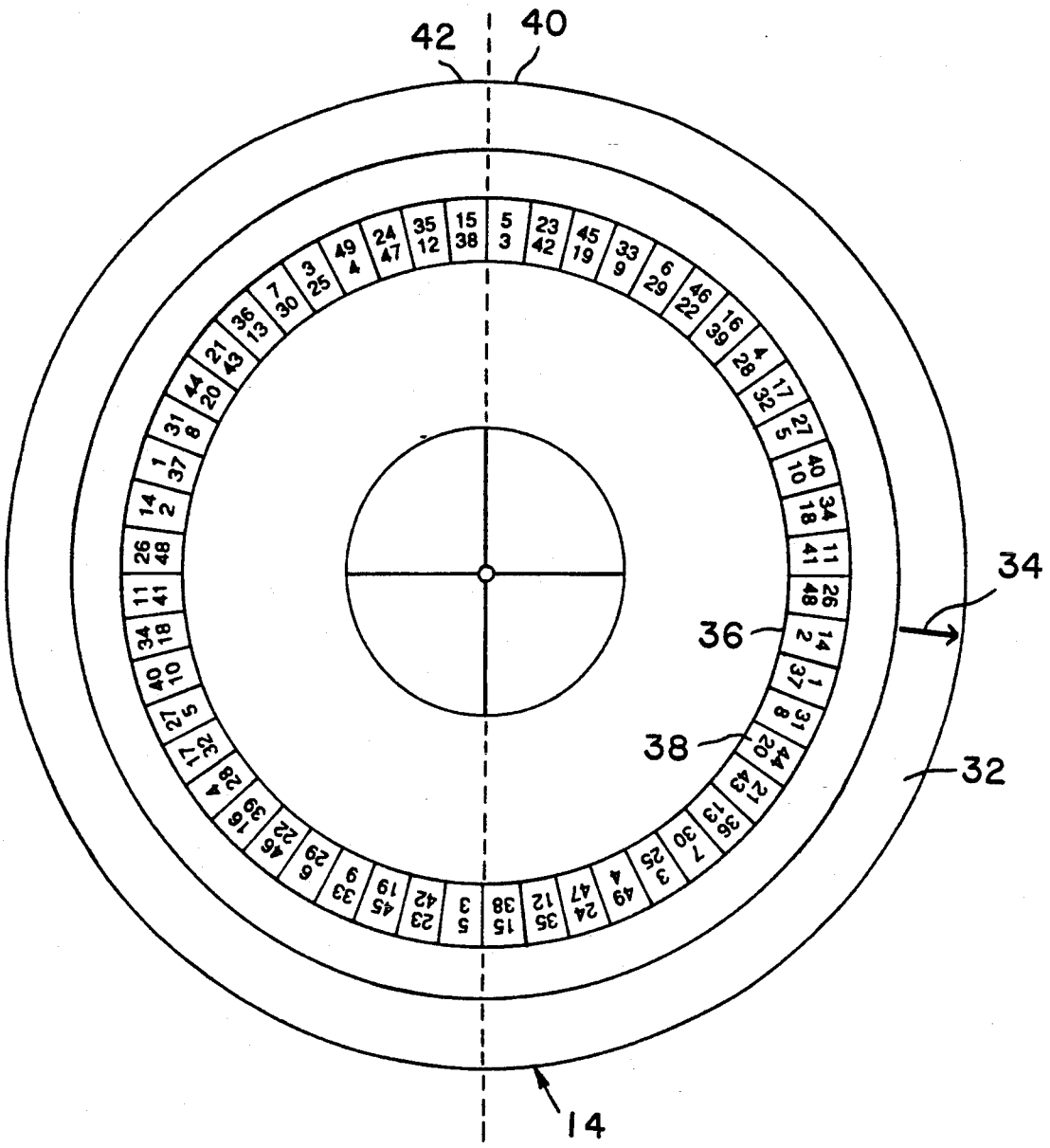
FIG. 3 is a top plan view of the second disk in a disassembled condition.

FIG. 3 illustrates the second disk 14 which is mounted to the first disk 12 about a common axis. The disk 14, preferably, has an outer ring 32 formed from a transparent material such as polyvinyl acetate or mylar. A single indicator 34, which is illustrated as an arrow in FIG. 3, is directed radially outward on the ring 32. A second ring 36 is concentric to the first ring 32 and disposed inwardly from the first ring 32. The second ring 36 is divided to define a plurality of ring segments 38. In the embodiment of FIG. 3, the ring 36 defines a number "2n" of segments 38 to complement the number of ring segments 26 in the second ring 24 of the disk 12. Each ring segment 38 includes two numbers. The ring 36 defines two symmetrical halves 40 and 42 where each half defines twenty-six rings segments 38. Each ring segment 38 includes two numbers from 1 to 49. The numbers are disposed randomly in each ring segment 36. In the embodiment of FIG. 3, twenty-six ring segments are shown for each half of the ring segment 36. Since the numbers in this embodiment are from 1 to 49, three randomly selected numbers repeat for each half in this embodiment The repeating numbers for this embodiment are 3, 4, and 5. The random numbers are, preferably, arranged in a column in each segment. Each half of the ring includes the random numbers in the same sequence such that each half is symmetrical.

Figure 4:
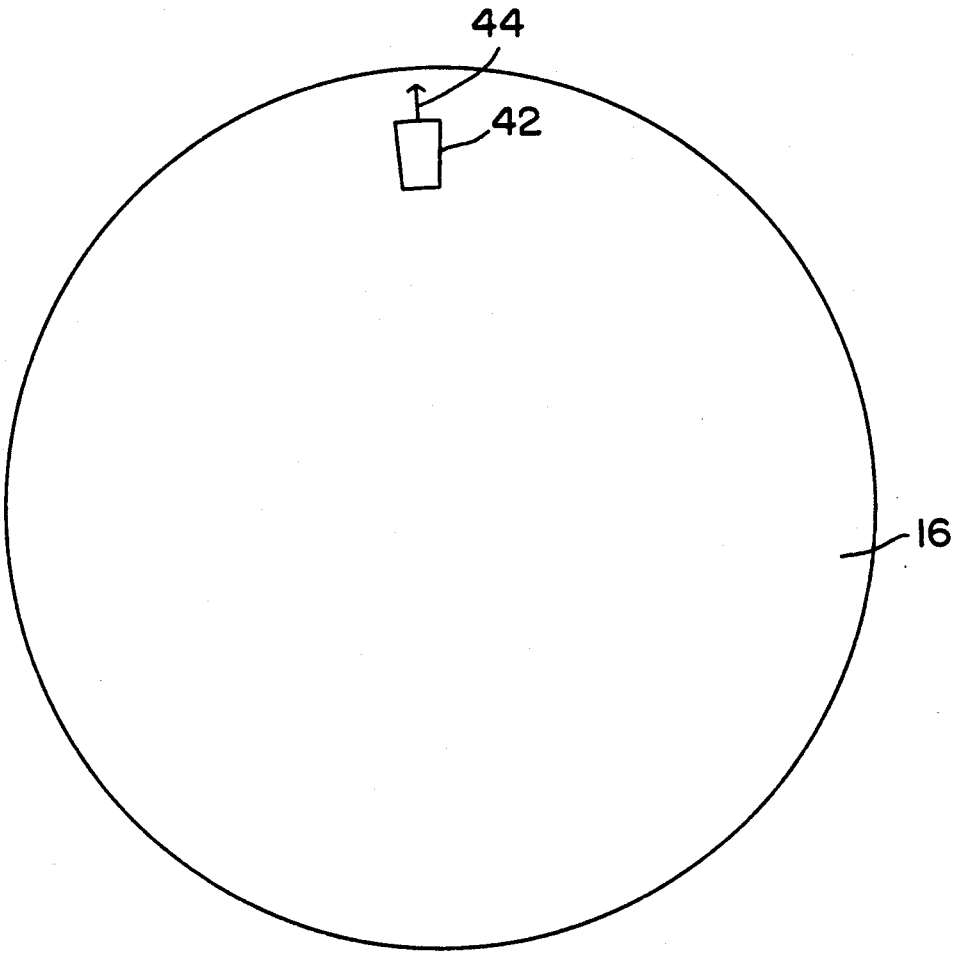
FIG. 4 is a top plan view of the third disk in a disassembled condition.

FIG. 4 illustrates the third outer disk 16 which is opaque and superimposed on the second disk 16 about the common axis. The third disk 16 has an outer dimension to obscure at least the ring segment 36 of the random numbers. A viewing window 40 is disposed in the disk 16 to view one of the ring segments 38 and the numbers of that ring segment. An indicator 44, in the form of an arrow, points outwardly from the outer disk 16.

The random number selector device 1 is easily assembled by inserting a pivot member, such as a standard rivet 42, through the center axis of each of the disks 12, 14, and 16. The disks are attached together to be readily rotatable with respect to each other. The second disk 14, preferably, is dimensioned so that the transparent ring 32 overlies the ring 24 of letters of the first base disk 12.

Figure 5:
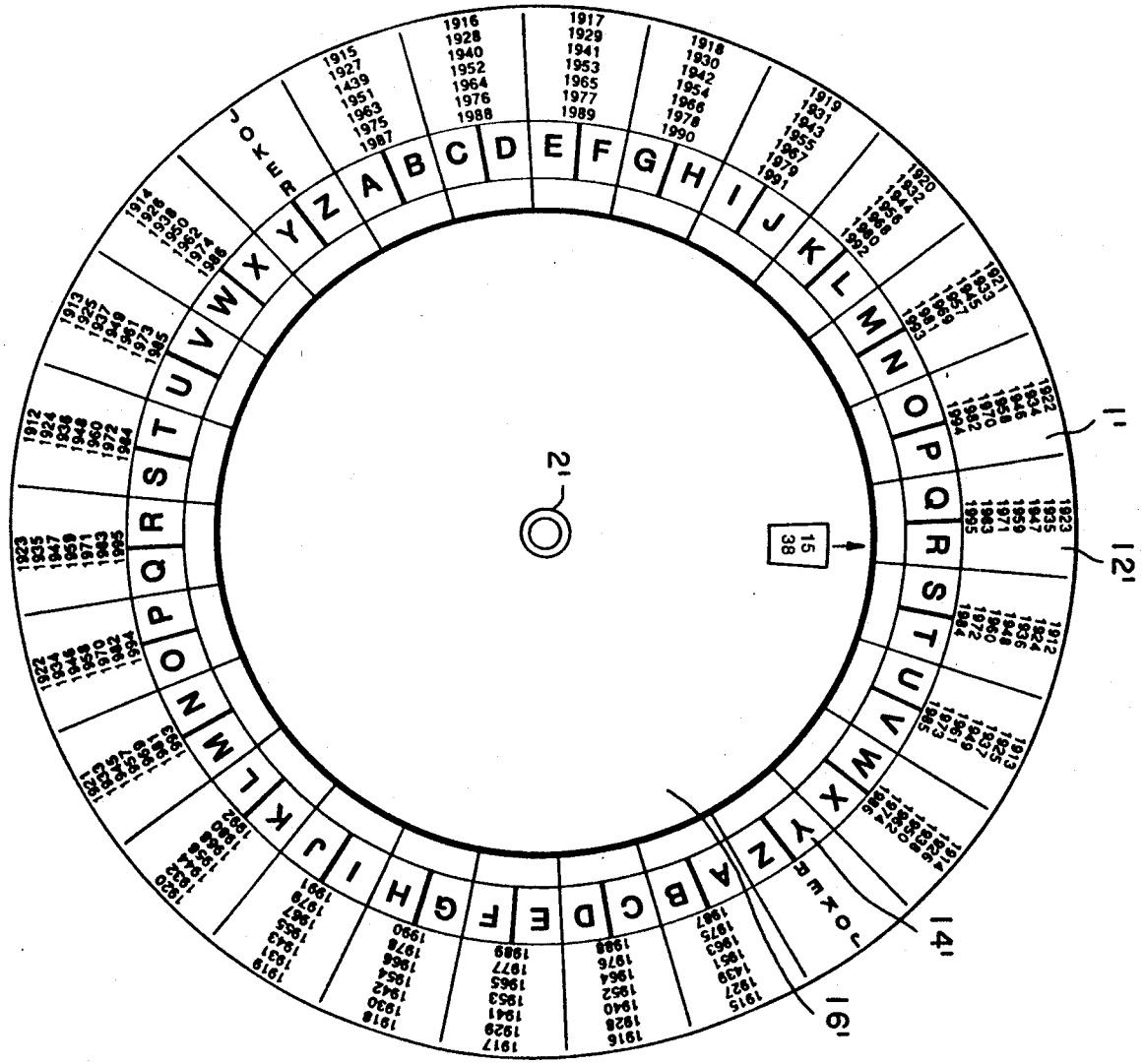
FIG. 5 is a top plan view of an alternative embodiment of the invention.

FIG. 5 illustrates an alternative embodiment of the present invention. This embodiment of the invention is directed to a random number selection device 1' comprising a base disk 12', a middle disk 14', and an upper, top disk 16'. The three disks are rotatably attached together about a common central axis by a spindle 2'.

The preferred embodiment of FIG. 1 of the invention provides twice the yield of random numbers than the embodiment of the invention that is illustrated in FIG. 5. This greater yield of random numbers is due to the different sequence of numbers that can be produced by operating the preferred embodiment of the invention in either a clockwise or counterclockwise direction. The embodiment of the invention illustrated in FIG. 5 is only operable in a unidirectional or clockwise direction.

In use, the operator selects a year of choice, for example the year of birth of the user, and rotates the second disk 14 with respect to the base disk 12 to align the arrow 34 with the center of the appropriate ring segment 26. The operator then rotates the third disk 16 with respect to the second disk 14 without movement of the second disk 14 with respect to the first disk 12. A word is selected and the third disk 16 is rotated to direct the arrow 44 to the first letter of the word and to display the numbers in the segments 38 through window 42. The top number is then recorded as the first random number. When a plurality of random numbers are to be selected, each letter of the selected word is used to select a number appearing in the window when the top disk is rotated to align the arrow with the appropriate letter. One or more words can be randomly chosen in any desired combination to randomly select the desired quantity of numbers. When a letter repeats itself, the bottom number in the window is selected to avoid repetition of numbers.

The random number selector of the invention enables the selection of numbers by the use of input information provided by the operator. The operator must select two unrelated pieces of input information in the form of a year and a letter of the alphabet to select a single number. The number of years available to choose and the infinite number of words, from which to select a letter, provides a means and a method for the random selection of numbers. The means for selecting the dates and the letters can be varied as desired by the operator. For example, the year can be selected by the year of birth of a family member or any other date personal to the operator. The letters can be selected by choosing any word or words in any order, using the first or last letter of a selected word, or the first letter of each word, phrase, or title.

In a preferred embodiment of the invention, the outer ring of the base disk includes the years from 1913 to 1995 and the second ring includes the letters of the alphabet defined in two symmetrical halves. In alternative embodiments, the ring segments can include any desired indicia which can be selected by the operator, including, for example, days of the week, months, holidays, seasons, phases of the moon, and the like. The "joker" space can be included when the operator is unable or does not desire to select a number from the outer ring. The second ring can also include any suitable indicia other than letters. In a preferred embodiment, the ring is divided in two halves with the letters arranged alphabetically in both a clockwise direction and a counterclockwise direction. Alternatively, the letters can be arranged alphabetically such that the two sets of the alphabet are arranged in the same direction.

The second disk 14, preferably, includes the transparent outer ring to allow viewing of the second ring of the first disk. The second ring of the second disk contains the numbers in random order. Each ring segment, preferably, includes two numbers such that, if the same letter is selected twice, the second number in the segment is used to prevent repetition of numbers.

In a further embodiment of the invention, the random numbers in the ring segments of the inner disk in each half are not symmetrical such that each half includes an independent, random array of numbers. The range of numbers can be determined by available numbers for the particular game. For example, a "Lotto game", typically, uses numbers from 1 to 49, so that 49 would be the highest number in the set.

In a further embodiment of the invention, the inner ring 36 defines two halves where the number arrangement in each half is asymmetrical. In the embodiment illustrated in FIG. 3, the numbers are arranged in a column in each ring segment, and each ring half is identical. In one alternative embodiment, the order of the numbers in each ring segment is reversed in each half, such that the number appearing on the top in one ring segment appears at the bottom in the opposing ring segment of the other half.

While advantageous embodiments have been chosen to illustrate the invention, it will be understood by those skilled in the art that various changes and modifications can be made therein without departing from the spirit and scope of the invention.

I claim:

1. A random number selection device comprising:

a first circular disk having a first circumferential outer ring of first equal-sized ring segments, each first ring segment having first indicia thereon, and a second ring concentric with said first outer ring and spaced inwardly therefrom, said second ring having second equal-sized ring segments having second indicia thereon;

a second circular disk having a third ring of third equal-sized ring segments, each segment having a third indicia in the form of at least one random number, said second disk having a diameter less than the diameter of said first disk; and a third circular disk mounted on top of said second circular disk covering said third ring segments from visual display, said third circular disk having means to visually display at least one of said third indicia; and first, second, and third circular disks being rotatably coupled about a common central axis such that all of said first and second ring segments are in visual display at all times.

2. The device according to claim I, wherein said third disk has a diameter less than the diameter of said second disk.

3. The device according to claim 1, wherein said means to display said third indicia comprises an aperture in said third disk, said third disk has a diameter greater than said third ring of ring segments.

4. The device according to claim 1, wherein said first ring comprises fifty-two ring segments.

5. The device according to claim 1, wherein said first ring comprises a variable n of ring segments and said second ring comprises a second variable n of ring segments.

6. The device according to claim 5, wherein said second ring comprises said second variable 2n of ring segments.

7. The device according to claim 6, wherein said third disk includes indicator means for indicating said indicia on said second ring of said ring segments.

8. The device according to claim 1, wherein said first ring segments includes indicia corresponding to numbers in sequence extending around said first ring.

9. The device according to claim 8, wherein at least two of said first ring segments include indicia other than said numbers.

10. The device according to claim 8, wherein said second ring segments includes second indicia corresponding to letters.

11. The device according to claim 10, wherein said second indicia corresponds to letters arranged alphabetically around said second ring.

12. The device according to claim 1, wherein said third ring of ring segments includes indicia corresponding to random numbers from 1 to 49.

13. The device according to claim 12, wherein each ring segment of said third ring includes two random numbers.

14. The device according to claim 12, wherein said third ring of ring segments comprises two symmetrical halves, each half including said random numbers.

15. The device according to claim 1, wherein said second disk includes a transparent outer ring concentric with said third ring, said transparent ring overlays said second ring and includes indicator means for indicating one of said first ring segments.

16. The device according to claim 1, wherein said second ring of ring segments comprises first and second symmetrical halves, said first half has letters arranged sequentially clockwise around said disk, said second half has letters arranged sequentially counterclockwise around said disk.

17. A random number selection device comprising:

a first circular disk having a first circumferential outer ring of first equal-sized ring segments each first ring segment hereby number thereon the numbers on each first ring segment are arranged sequentially around said first ring, and a second circumferential ring concentric with said first ring and spaced inwardly therefrom, said second ring having two second equal-sized ring segments corresponding to each first ring segment, said second ring segments include letters arranged alphabetically around said disk;

a second circular disk having a third ring comprising a number of third uniform-sized ring segments equal to the number of said second ring segments, each of said third ring segments comprises at least one random number, said second disk has a diameter less than said first ring; and a third circular disk mounted on top of said second circular disk covering said third ring segments from visual display, said third circular disk having cut-out means to visually display selectively said numbers in said third ring said first, second, and third disks being rotatably coupled together about a common central axis such that all of said first and second ring segments are in visual display at all times.

18. The device according to claim 17, wherein said second disk includes an outer ring of transparent material whereby said outer ring overlies said second ring of said first disk and said third ring of ring segments is contiguous with said outer ring of transparent material.

19. The device according to claim 17, wherein said second ring comprises the first and second halves of twenty-six segments each, said segment of said first half includes letters arranged alphabetically in a clockwise direction, and said second half includes letters arranged in a counterclockwise direction.

20. A method for randomly selecting a number by using a random number selection device having:

a first circular disk having a first circumferential outer ring of first equal-sized ring segments, each first ring segment has numbers arranged sequentially around said first ring, and a second circumferential ring concentric with said first ring and spaced inwardly therefrom, said second ring having two second equal-sized ring segments corresponding to each first ring segment, said second ring segments including letters arranged alphabetically around said disk said first and second ring segments being in visual display at all times;

a second circular disk having a third ring comprising a number of third uniform-sized ring segments equal to the number of said second ring segments, each of said third ring segments comprising at least one random number, said second disk having a diameter less than said first ring and having a first radial indicator means located at the edge of said second disk; and a third circular disk mounted on top of said second circular disk covering said third ring segments from visual display, said third circular disk having cut-out means to visually display selectively said numbers said third ring segment and having a second radial indicated means located at the edge of said third disk; and first, second, and third disks being rotatably coupled together about a common central axis wherein said first indicator means is in close proximity to any one of said first ring segments, and wherein said second indicator means is in close proximity to any one of said second ring segments; said method comprising:

a rotating said second disk with respect to said first disk;

aligning said first indicator means with a randomly selected keeping fixed the alignment of the first indicator means with the randomly selected number while number in said first ring;

rotating said third disk with respect to said second disk;

aligning said second indicator means with a randomly selected letter in said second ring; and recording said random number being displayed in said cut-out means.

* * * * *